US009989297B1

(12) United States Patent
Akalan et al.

(10) Patent No.: US 9,989,297 B1
(45) Date of Patent: Jun. 5, 2018

(54) HOME APPLIANCE DOOR

(71) Applicant: BSH HAUSGERAETE GMBH, Munich (DE)

(72) Inventors: Yigit Akalan, Tekirdag (TR); Ziya Arslankiray, Tekirdag (TR); Emre Emek, Istanbul (TR)

(73) Assignee: BSH Hausgeraete GmbH, Munich (DE)

( * ) Notice: Subject to any disclaimer, the term of this patent is extended or adjusted under 35 U.S.C. 154(b) by 0 days. days.

(21) Appl. No.: 15/360,214

(22) Filed: Nov. 23, 2016

(51) Int. Cl.

| | |
|---|---|
| ***A47B 96/04*** | (2006.01) |
| ***F25D 23/02*** | (2006.01) |
| ***F25D 11/00*** | (2006.01) |
| ***E06B 7/28*** | (2006.01) |
| ***E06B 5/00*** | (2006.01) |
| ***E06B 7/18*** | (2006.01) |

(52) U.S. Cl.
CPC ..... *F25D 23/02* (2013.01); *E06B 5/00* (2013.01); *E06B 7/18* (2013.01); *E06B 7/28* (2013.01); *F25D 11/00* (2013.01); *F25D 23/028* (2013.01); *F25D 2323/021* (2013.01); *F25D 2400/06* (2013.01)

(58) Field of Classification Search
CPC ..... F25D 2323/021; F25D 11/00; F25D 2400/06; F25D 23/02; F25D 23/028; E06B 7/18; E06B 7/28; E06B 5/00; E05D 11/0054; E05D 11/0072
See application file for complete search history.

(56) References Cited

U.S. PATENT DOCUMENTS

| | | | | | |
|---|---|---|---|---|---|
| 4,711,098 | A * | 12/1987 | Kuwabara | F25D 11/022 | 312/321.5 |
| 5,224,240 | A * | 7/1993 | Smith | B05B 15/045 | 118/505 |
| 5,411,328 | A * | 5/1995 | You | F25D 23/028 | 312/296 |
| 5,694,789 | A * | 12/1997 | Do | F25D 23/02 | 312/405 |
| 9,234,695 | B1 * | 1/2016 | Dubina | F25D 23/028 | |
| 2005/0046319 | A1 * | 3/2005 | Chekal | F25D 11/02 | 312/401 |
| 2007/0257589 | A1 * | 11/2007 | Laible | F25D 23/02 | 312/405 |
| 2009/0273264 | A1 * | 11/2009 | Butler | F25D 23/028 | 312/405 |
| 2010/0125970 | A1 * | 5/2010 | Leimkuehler | E05D 11/0054 | 16/251 |
| 2014/0026361 | A1 * | 1/2014 | Kim | E05D 11/0054 | 16/251 |
| 2014/0097733 | A1 * | 4/2014 | Seo | F25D 23/02 | 312/324 |
| 2014/0159560 | A1 * | 6/2014 | Jung | F25D 23/028 | 312/405 |
| 2014/0265804 | A1 * | 9/2014 | Wilson | F25D 23/02 | 312/405 |

(Continued)

*Primary Examiner* — Hanh V Tran
(74) *Attorney, Agent, or Firm* — Laurence A. Greenberg; Werner H. Stemer; Ralph E. Locher

(57) ABSTRACT

For the purpose of improving operation and maintenance a home appliance door, in particular a home chiller appliance door, is proposed: The home appliance door has an inner wall section; and at least one support unit for support of a door mullion, the support unit being fixated to the inner wall section at least in a form-fit and/or force-fit manner.

15 Claims, 3 Drawing Sheets

(56) References Cited

U.S. PATENT DOCUMENTS

| | | | | |
|---|---|---|---|---|
| 2015/0015133 | A1* | 1/2015 | Carbajal | A47F 3/04 312/405 |
| 2015/0107052 | A1* | 4/2015 | Talpe | E05D 3/02 16/251 |
| 2015/0219387 | A1* | 8/2015 | Kim | F25D 23/028 312/404 |
| 2016/0178267 | A1* | 6/2016 | Hao | F25D 23/02 312/405 |

* cited by examiner

HOME APPLIANCE DOOR

BACKGROUND OF THE INVENTION

The invention relates to a home appliance door, in particular a home chiller appliance door, and to a method for assembly of a home appliance door.

From the prior art a home appliance door is already known, comprising an inner wall section which is implemented integrally with a support unit for support of a door mullion.

SUMMARY OF THE INVENTION

An objective of the invention is, in particular, to provide a home appliance door with improved characteristics regarding operation and maintenance. This objective is achieved, according to the invention, while further implementations and further developments of the invention may be gathered from the dependent claims.

A home appliance door, for example a home chiller appliance door, is proposed, comprising: an inner wall section; and at least one support unit for support of a door mullion, the support unit being fixated to the inner wall section at least in a form-fit and/or force-fit manner.

By means of the invention in particular a usability of the home appliance door can be improved. Also, an efficiency of an assembly and/or disassembly of the door mullion can be improved, while in particular cost can be reduced due to common part usage. Further, in particular a maintenance and serviceability of the home appliance door can be facilitated.

The home appliance door is in particular part of a home appliance, in particular a home chiller appliance. The home appliance is, in this context, in particular provided for storing and preferably tempering victuals, such as beverages, in particular alcoholic beverages, such as wine, and/or meat, fish, vegetables, fruits, milk and/or dairy products, in at least one operating state, advantageously for the purpose of enhancing a quality and/or a storage life of the stored victuals. For example, the home appliance is embodied as a home chiller appliance, which is in at least one operating state configured for cooling victuals. The home chiller appliance could in particular be embodied as a climate cabinet, an ice-box, a wine-cooler, a freezer and/or a refrigerator-freezer combination. For example, the home chiller appliance may be embodied as a refrigerator. However, the home appliance could also be embodied as a home appliance for warming and in particular for cooking victuals, e.g. an oven, a cooker and/or a microwave. The home appliance comprises in particular a housing preferably defining a storage space, which is in particular provided for storing victuals.

In this context, "configured" is in particular to mean specifically designed and/or equipped. By an object being configured for a certain function is in particular to be understood that the object implements and/or fulfills said certain function in at least one application state and/or operating state.

The home appliance may in particular comprise at least one or at least two or a plurality of home appliance doors. For example, the home appliance comprises a French-door-system which includes at least two home appliance doors of this kind. In particular in the case of a French-door-system the two home appliance doors may share a door mullion, which is in particular part of one of the two home appliance doors and is in particular fixated to a door housing of the respective home appliance door. The two home appliance doors may in particular be arranged mirror-invertedly to one another and may be mounted to opposite sides of a door frame of the home appliance. The door mullion may in particular be implemented as a flip mullion configured to rotate during an opening and/or closing process of the home appliance door. A rotation axis of the door mullion may in particular be at least substantially parallel to an axis of rotation of the home appliance door. In this context, "at least substantially parallel" is in particular to be understood as an orientation of a direction with respect to a reference direction, in particular in a plane, wherein the direction and the reference direction include an angle of 0°, the orientation in particular having a deviation of less than 15°, advantageously of less than 10° and particularly advantageously of less than 2°.

In particular in a closed state of the home appliance door, the inner wall section faces towards the storage space and may at least partly delimit the storage space. The inner wall section may at least partly be or at least mostly or entirely at least substantially flat. The term "at least mostly" with reference to an object is in particular to mean by more than 50% or by more than 65% or by more than 80% or by more than 95% of an object, in particular of a surface area and/or of a volume and/or of a mass of the object. In this context, "an object being at least substantially flat" is in particular to mean that the object comprises maximum surface irregularities which extend in a direction which is at least substantially perpendicular to a main extension plane of the object to a degree of at most 10%, preferably at most 5% and advantageously at most 1% of a main extension of the object. A "main extension plane" of an object is, in particular, to be understood as a plane which is parallel to a largest side of an imaginary rectangular cuboid which only just entirely encloses the object. In this context, "at least substantially perpendicular" is in particular to be understood as an orientation of a direction with respect to a reference direction, in particular in a plane, wherein the direction and the reference direction include an angle of 90°, the orientation having in particular a deviation of less than 15°, advantageously of less than 10° and particularly advantageously of less than 2°.

Further the door housing may comprise at least one outer wall section. In particular in a closed state of the home appliance door, the outer wall section may face away from the storage space and may at least partly embody a front face of the home appliance door. In particular, the inner wall section and the outer wall together may at least partly delimit an interior space of the door housing of the home appliance door. For example the interior space may at least partly or at least mostly or entirely be filled with an insulating means, in particular foam, for example polymer foam, e.g. polyurethane foam.

In this context, a "support unit" is in particular to be understood as a unit which is configured for supporting a weight force of the door mullion. The support unit may embody at least partly a hinge for the door mullion. In this context, the term "fixated" is in particular to mean releasably fixated, either using tools or without tools. By the term "fixating in a force-fit and/or form-fit manner" is in particular to be understood for example releasably fixated, wherein a holding force between two structural components may be transferred via a geometric engagement of the structural components with each other and/or via a friction force acting between the structural components, such as for example a screw fixation. Alternatively or additionally a connection may be provided by substance-to-substance bond, for example an adhesive and/or cohesive connection. For fixating the support unit to the inner wall section, the home appliance door may comprise in particular at least one, in particular at least two fixation units. The fixation unit may fix the support unit to the inner wall section by means of a screw fixation.

It is further proposed that the support unit may comprise a support element for supporting the door mullion, and a cover element which at least partly or at least mostly covers the support element, in particular when viewed at least in a direction which is at least substantially perpendicular to the main extension plane of the inner wall section. The support element may comprise at least three, in particular exactly three side edges which extend at least partly at least substantially parallel to one another. The support element may comprise at least three, in particular at least four angular deflections, each of which may have an angle of at least substantially 90°. In this context, "an angle of at least substantially 90°" is in particular to mean an angle of 90° having in particular a deviation of less than 15°, advantageously of less than 10° and particularly advantageously of less than 2°. The support element may enclose an imaginary rectangular cuboid from at least three, in particular at least four sides. Further the support element may comprise at least two sides which are free of an overlap when viewed in a direction which is at least substantially perpendicular to a main extension plane of one of those sides. The support element may comprise, in particular may enclose, in particular at least partly, an assembly space, which may be configured for assembly of the door mullion. The cover element may in particular be implemented as a rectangular cuboid and may at least partly enclose in particular a receiving space. In particular in an installed state of the support unit, the support element may at least partly or at least mostly or entirely be arranged inside the receiving space of the cover element. Furthermore, in particular in an installed state of the support unit, the fixation unit may at least partly or at least mostly or entirely be covered by the cover element and may in particular be at least partly or at least mostly or entirely arranged inside the receiving space of the cover element. In particular, in a fixated state of the support unit, the support element may at least partly or at least mostly or entirely be arranged between the inner wall section and the cover element. The support element comprises in particular at least one fixation element of the fixation unit, for fixating the support unit to the inner wall section. The fixation element may in particular be implemented as a fixation hole. Furthermore the inner wall section may comprise a further fixation element of the fixation unit, which interacts with the fixation element of the support element for fixating the support unit to the inner wall section. The further fixation element may in particular be implemented as a fixation bore. The fixation unit may comprise an interaction element which interacts with the fixation element and the further fixation element. The interaction element may in particular be implemented as a screw. As a result of this, in particular a design can be further improved as the supporting element and components for fixation unit can be hidden from sight.

In a further embodiment of the invention it is proposed that the cover element may comprise at least one or at least two or exactly two connection elements, and the support element may comprise at least one or at least two or exactly two corresponding connection elements, which cooperate with the connection elements for connecting the cover element to the support element at least in a form-fit and/or force-fit manner. The connection element may in particular be embodied as a snap hook. The corresponding connection element may in particular be embodied as a snap edge. For example the support element may comprise at least one receiving recess for receiving at least the connection element. An edge of the receiving recess may embody the corresponding connection element. In this way, in particular an assembly can be simplified.

In particular for the purpose of improving characteristics regarding maintenance and serviceability, in particular facilitating a replacement of the support unit and/or one of its components, it is proposed that the cover element may be connectable to the support element by at least one movement of the cover element with respect to the support element in a direction which is at least substantially parallel to the main extension plane of the inner wall section, in particular until the connection element of the cover element cooperates with the corresponding connection element of the support element. In particular, the cover element is connectable to the support element by at least one movement of the cover element with respect to the support element in a direction which is at least substantially perpendicular to the main extension plane of the inner wall section. In particular, during assembly the cover element may be moved initially in a direction which is at least substantially perpendicular to the main extension plane of the inner wall section and subsequently in a direction which is at least substantially parallel to the main extension plane of the inner wall section. In particular, the support element may comprise an alignment element and the cover element may comprise a corresponding alignment element, which are configured for indicating a positioning of the support element with respect to the cover element. The support element may be connected to the cover element when the alignment element and the corresponding alignment element are arranged aligned with each other. The alignment elements may be implemented as alignment recesses.

It is also proposed that the home appliance door may further comprise the door mullion, wherein the support unit may comprise at least one mounting element for mounting the door mullion to the inner wall section. In particular, a corresponding mounting element of the door mullion can be attached to the mounting element. The mounting element may in particular be embodied as a screw bore. The corresponding mounting element may in particular be implemented as a hanger screw or hanger bolt. The mounting element may in particular be arranged at a lateral side of the support element, which faces towards the door mullion. The cover element may comprise in particular an assembly recess which is configured for preventing the corresponding mounting element of the support element being covered.

It is conceivable that the cover element and/or the support element may at least partly be implemented integrally. In this context, "Implemented integrally" is in particular to mean, in this context, connected at least by substance-to-substance bond, e.g. by a welding process, an adhesive bonding, an injection-molding process and/or by another process that is deemed expedient by a person having ordinary skill in the art. "Implemented integrally" could in particular mean made of one piece. In an embodiment the support element and the cover element are separate components. In particular for the purpose of improving fabrication of the support unit, it is proposed that the support element is implemented in one piece. "Made of one piece" is in particular to mean, in this context, manufactured from one single piece, e.g. by production from one single cast and/or by manufacturing in a one-component or multi-component injection-molding process, and for example from a single blank. Further, in particular the cover element is implemented in one piece.

It is further proposed that the support element may be implemented as a bent piece of sheet metal. The cover element may be implemented as an injection-molded part. The cover element may at least partly or at least mostly or entirely be made of plastic. As a result, in particular fabrication costs can be reduced.

In particular for the purpose of further improving the design, it is proposed that the inner wall section may comprise an inner liner and a cover sheet which at least partly or at least mostly or entirely cover the inner liner, in particular viewed at least substantially perpendicularly to the main extension plane of the inner wall section. The cover sheet may in particular at least partly or at least mostly or entirely in direct contact with the inner liner. The inner liner may in particular be at least partly or at least mostly or entirely made of plastic, in particular a thermoplastic. The cover sheet may in particular at least partly or at least mostly or entirely be made of metal. For example the cover sheet is made of sheet metal. Alternatively or additionally the inner liner may be at least partly or at least mostly or entirely made of metal. The further fixation element of the inner wall section may in particular at least partly be embodied by a first fixation sub-element of the inner liner. The first fixation sub-element may be embodied as a fixation hole. The further fixation element may in particular be at least partly embodied by a second fixation sub-element of the cover sheet. The first fixation sub-element may be embodied as a fixation hole.

In addition it is proposed that the cover sheet may be arranged at least partly or at least mostly or entirely between the inner liner and the support unit, in a fixated state of the support unit. As a result, in particular a stability of the fixation of the support unit to the inner wall section may be improved.

Furthermore it is proposed that the inner liner may comprise a hollow portion in a vicinity of the support unit, in a fixated state of the support unit. The hollow portion may in particular be covered at least partly or at least mostly or entirely by the cover sheet. The hollow portion may in particular be used for mounting the door mullion to the inner wall section. In this context, a "vicinity" is in particular to be understood as a circular area around a respective object, having a radius of at most 10 cm or of at most 5 cm or of at most 2 cm. As a result, in particular stability can be improved. It is also proposed that the cover sheet may comprise a cut-out in a vicinity of the support unit, in a fixated state of the support unit, in particular at the position of the hollow portion.

The support unit may in particular be arranged at an upper portion of the inner wall section. For the purpose of improving mounting and in particular a stability of the door mullion, it is proposed that the home appliance door may comprise a further support unit having a further support element which may be implemented at least substantially identically to the support element of the support unit. In this context, a "further object being at least substantially identical to an object" is in particular to mean that the further object is implemented identically to the object except for production, manufacturing and/or assembly tolerances. In particular, the further support unit is arranged at a lower portion of the inner wall section. The further support unit may comprise a further cover element. The further cover element may differ at least partly from the cover element of the cover unit. The further cover element may comprise in particular an additional assembly recess which is configured for preventing an assembly recess of the support element being covered.

Further a method for assembly of a home appliance door, in particular a home chiller appliance door, is proposed, wherein at least one support unit for support of a door mullion is being fixated to an inner wall section at least in a form-fit and/or force-fit manner. In this way in particular a usability of the home appliance door can be improved.

Herein the home appliance door and the method for assembly of a home appliance door are not to be limited to the application and implementation described above. In particular, for the purpose of fulfilling a functionality herein described, the home appliance door may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

DETAILED DESCRIPTION OF THE INVENTION

Figure 1:
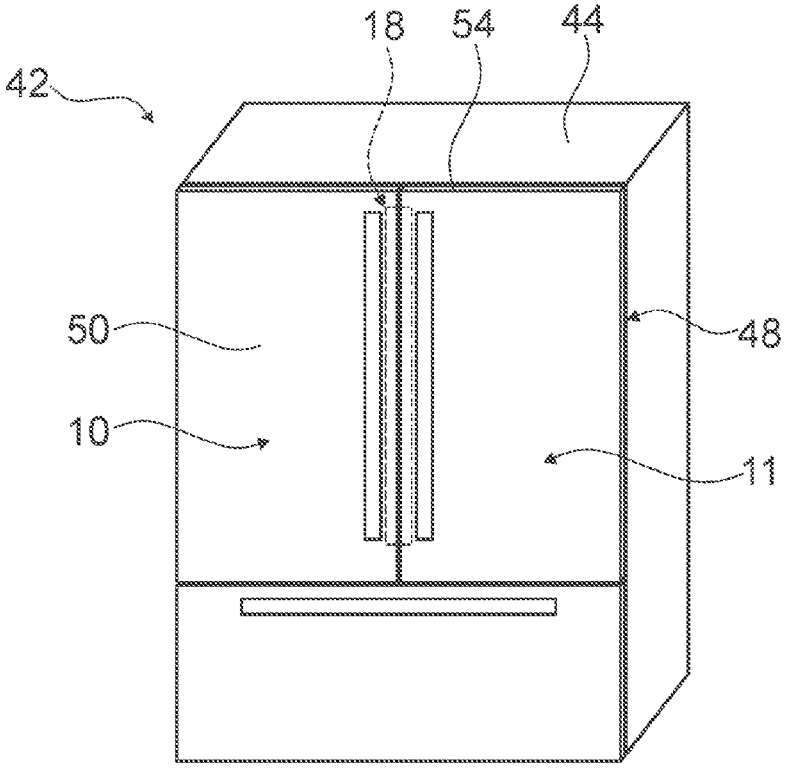
FIG. 1 a home appliance comprising a home appliance door in a schematic perspective view, FIG. 2 a portion of the home appliance comprising a home appliance door in a rear view, FIG. 3 a portion of the home appliance door comprising a support unit, in a perspective view, FIG. 4 a portion of the home appliance door comprising the support unit, in a cross-sectional view, and FIG. 5 a portion of the home appliance door comprising a further support unit, in a perspective view.

FIG. 1 shows a home appliance 42 in a schematic perspective view. The home appliance 42 is embodied as a refrigerator. The home appliance 42 could further be embodied as any other kind of home appliance deemed advantageous by someone skilled in the art, e.g. a climate cabinet, an ice-box, a freezer, a wine-cooler and/or a refrigerator-freezer combination.

The home appliance 42 comprises a housing 44. The housing 44 delimits a storage space for storing of victuals. The housing 44 comprises a door frame 54.

The home appliance 42 comprises at least one home appliance door 10, 11. In the present case the home appliance 42 comprises a home appliance door 10 and a further home appliance door 11. The home appliance doors 10, 11 implement a French-door-system. The home appliance door 10 and the further home appliance door 11 are arranged opposite each other. The home appliance doors 10, 11 share a door mullion 18. The home appliance doors 10, 11 are arranged mirror-invertedly to one another. The home appliance doors 10, 11 are mounted to opposite sides of a door frame 54. The home appliance doors 10, 11 comprise differing opening and/or closing directions.

It is conceivable that the home appliance 42 may comprise a differing number of home appliance doors 10, 11 as deemed advantageous by someone skilled in the art. In the following the home appliance door 10 is described in detail. The following description may be applied to the further home appliance door 11 accordingly. Alternatively the home appliance door 10 and the further home appliance door 11 may be implemented differently from each other.

Figure 2:
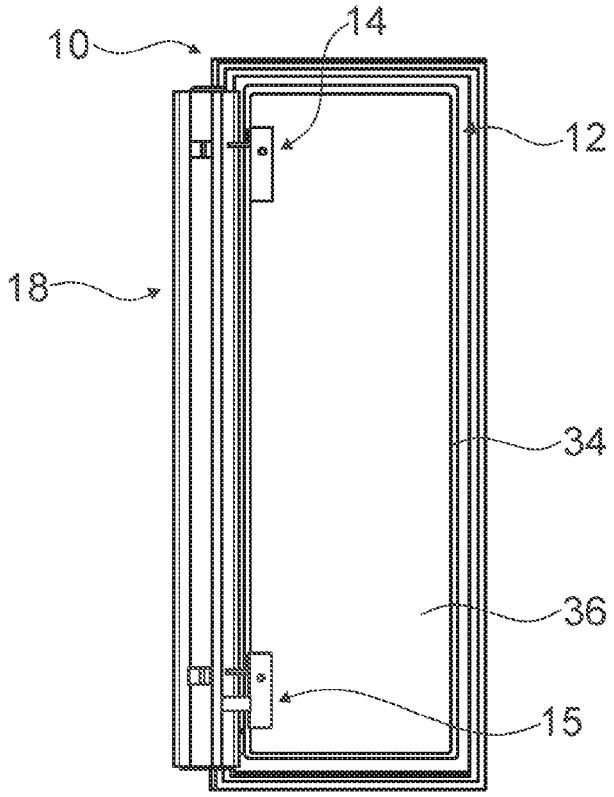

FIG. 2 shows a portion of the home appliance 42 comprising the home appliance door 10. The home appliance door 10 comprises an outer wall section 50. In the closed state of the home appliance door 10, the outer wall section 50 faces away from the storage space. The outer wall section 50 at least partly embodies a front of the home appliance door 10.

FIG. 2 shows a rear view of the home appliance door 10. The home appliance door 10 comprises an inner wall section 12. The inner wall section 12 is a wall section which faces towards the storage space in a closed state of the home appliance door 10.

The home appliance door 10 comprises a door housing 48. The door housing 48 is at least partly made of the inner wall section 12. Further the door housing 48 is at least partly made of the outer wall section 50. The inner wall section 12 and the outer wall section 50 together delimit an interior space of the door housing 48. The interior space is at least partly filled with an insulating means. The insulating means is implemented as foam, preferably polymer foam, advantageously polyurethane foam.

The inner wall section 12 comprises an inner liner 34. The inner liner 34 is at least partly implemented of plastic, in particular a thermoplastic. The inner wall section 12 comprises a cover sheet 36. The cover sheet 36 is at least partly made of metal. The cover sheet 36 is made of sheet metal. The cover sheet 36 at least mostly covers the inner liner 34, in particular viewed in a direction that is at least substantially perpendicular to a main extension plane of the inner wall section 12. The cover sheet 36 is in contact with and/or covers most of a surface area of the inner liner 34.

The home appliance door 10 comprises the door mullion 18. In a closed state of the home appliance door 10, the door mullion 18 is arranged in vicinity of the further home appliance door 11 (see FIG. 1). The door mullion 18 is implemented as a stopper for the home appliance doors 10, 11. The door mullion 18 is implemented as a flip mullion. The door mullion 18 is configured to rotate during an opening and/or closing process of the home appliance door 10 and/or the further home appliance door 11. A rotation axis of the door mullion 18 is at least substantially parallel to an axis of rotation of the door 10 and/or the further home appliance door 11.

The home appliance door 10 comprises at least one support unit 14 for support of the door mullion 18. The support unit 14 is arranged at an upper portion of the inner wall section 12. Further the home appliance door 10 comprises a further support unit 15. The further support unit 15 is arranged at a lower portion of the inner wall section. The support unit 14 and the further support unit 15 are at least partly implemented at least substantially identical to one another. It is conceiveble that the home appliance door 10, 11 may comprise a differing number of support units 14, 15 as deemed advantageous by someone skilled in the art. In the following description the support unit 14 is described in detail. Regarding the further support unit 15, regarding structural elements, features and functions that remain the same the description of the support unit 14 may be referred to. The description regarding the further support unit 15 is substantially limited to the differences with respect to the support unit 14.

Figure 3:
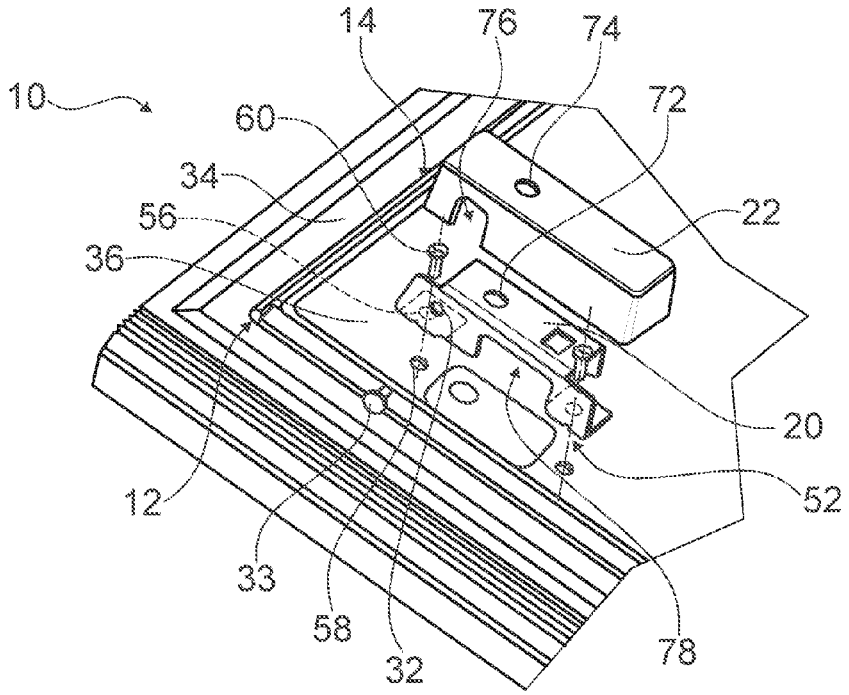
Figure 4:
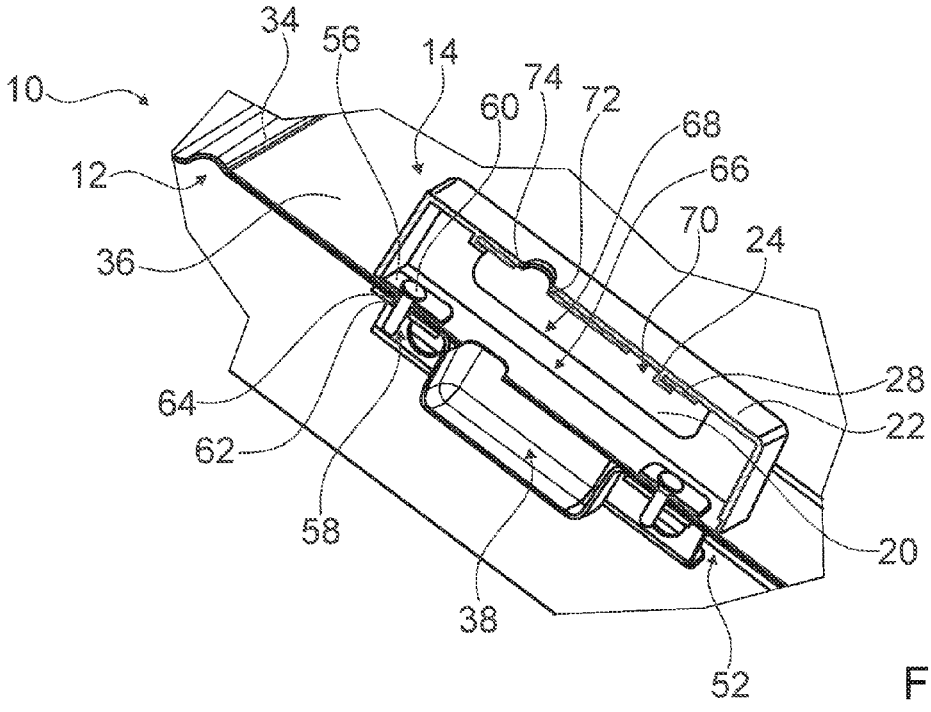
Figure 5:
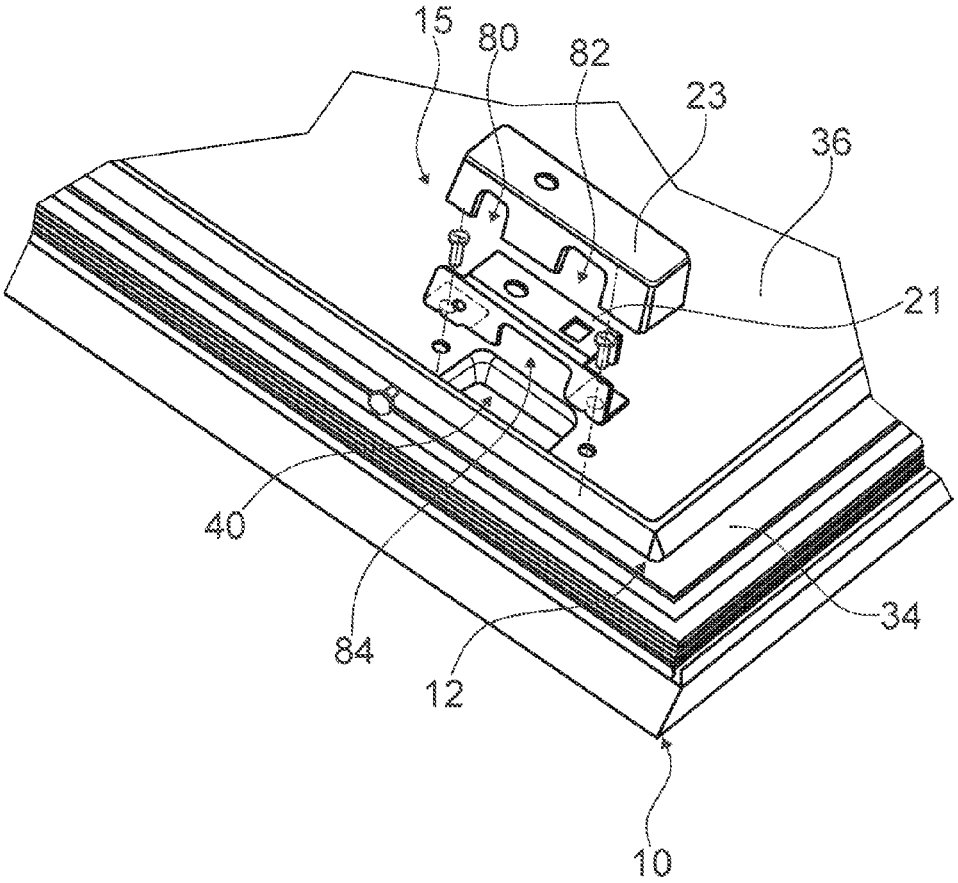

FIGS. 3, 4 show a portion of the home appliance door 10 with the support unit 14 in a perspective view and in a cross-sectional view. The support unit 14 embodies at least partly a hinge for the door mullion 18. The inner liner 34 comprises a hollow portion 38 in a vicinity of the support unit 14, in a fixated state of the support unit 14. The hollow portion 38 may be covered at least mostly by the cover sheet 36. The hollow portion 38 may in particular be used for mounting the door mullion 18 to the inner wall section 12. The home appliance door 10 comprises a fixation unit 52. The support unit 14 is fixated to the inner wall section 12 at least in a form-fit and/or force-fit manner. In the present case the support unit 14 is fixated to the inner wall section 12 by means of the fixation unit 52. The fixation unit 52 fixes the support unit 14 to the inner wall section 12 by means of a screw connection.

The support unit 14 comprises a support element 20. The support element 20 supports the door mullion 18. The support element 20 comprises at least one fixation element 56 of the fixation unit 52, for fixating the support unit 14 to the inner wall section 12. In the present case the support element 20 comprises two fixation elements 56 of the fixation unit 52. The fixation element 56 is implemented as a fixation hole. Furthermore, the inner wall section 12 comprises at least one further fixation element 58 of the fixation unit 52, which interacts with the fixation element 56 of the support element 20 for fixating the support unit 14 to the inner wall section 12. In the present case the inner wall section 12 comprises two further fixation elements 58. The further fixation element 58 is implemented as a fixation bore. The further fixation element 58 of the inner wall section 12 is at least partly embodied by a first fixation sub-element 62 of the inner liner 34. The first fixation sub-element 62 is embodied as a fixation hole. The further fixation element 58 is at least partly embodied by a second fixation sub-element 64 of the cover sheet 36. The second fixation sub-element 64 is embodied as a fixation hole.

The fixation unit 52 comprises at least one interaction element 60. The interaction element 60 interacts with the fixation element 56 and the further fixation element 58 for fixating the support unit 14 to the inner wall section 12. In the present case the fixation unit 52 comprises two interaction elements 60. The interaction element 60 is implemented as a screw.

In a fixated state of the support unit 14, the cover sheet 36 is arranged at least partly between the inner liner 34 and the support unit 14.

The support element 20 comprises three side edges which extend at least partly at least substantially parallel to one another. The support element 20 comprises three angular deflections. The angular deflections comprise each an angle of at least substantial 90°. The support element 20 encloses an imaginary rectangular cuboid from at least four sides. Further the support element 20 comprises at least two sides which are free of an overlap when viewed in a direction which is at least substantially perpendicular to a main extension plane of one of these sides. The support element 20 encloses at least partly an assembly space 66. The assembly space 66 may preferably be configured for assembly of the door mullion 18. Further, the support element 20 comprises a receiving recess 78. The receiving recess 78 is positioned at lateral side of the support element 20. The receiving recess 78 is configured to provide access to the assembly space 66.

The support element 20 is implemented in one piece. The support element 20 is implemented as a bent piece of sheet metal.

The support unit 14 further comprises a cover element 22. The cover element 22 at least partly covers the support element 20 viewed in a direction which is at least substantially perpendicular to the main extension plane of the inner wall section 12. The cover element 22 implemented as a rectangular cuboid. The cover element 22 encloses a receiving space 68. In an installed state of the support unit 14 the support element 20 is entirely arranged inside the receiving space 68. In an installed state of the support unit 14 the fixation unit 52 is at least partly covered by the cover element 22. Furthermore, in an installed state of the support unit 14 the fixation unit 52 is at least partly arranged inside the receiving space 68 of the cover element 22. The cover element 22 covers the fixation unit 52. In a fixated state of the support unit 14 the support element 20 is at least partly arranged between the inner wall section 12 and the cover element 22. In the case of the support unit 14, the receiving recess 78 is covered by the cover element 22.

The cover element 22 comprises at least one connection element 24. In the present case the cover element 22 comprises two connection elements 24. The connection element 24 is embodied as a snap hook. The support element 20 comprises at least one corresponding connection element 28. In the present case the support element 20 comprises two corresponding connection elements 28. The corresponding connection element 28 is embodied as a snap edge. The support element 20 comprises a receiving recess 70. Through the receiving recess 70 the connection element 24 engages with the corresponding connection element 28. An edge of the receiving recess 70 embodies the corresponding connection element 28. The corresponding connection element 28 cooperates with the connection element 24 for connecting the cover element 22 to the support element 20 at least in a form-fit and/or force-fit manner. The corresponding connection element 28 snaps into the connection element 24 for connecting the cover element 22 to the support element 20 at least in a form-fit and/or force-fit manner.

For connecting the cover element 22 to the support element 20, the cover element 22 is moved with respect to the support element 20 at least substantially perpendicularly to the main extension plane of the inner wall section 12. Further the cover element 22 is moved with respect to the support element 20 in a direction which is at least substantially parallel to the main extension plane of the inner wall section 12.

The support element 20 comprises an alignment element 72. The cover element 22 comprises a corresponding alignment element 74. The alignment elements 72, 74 are configured for indicating a positioning of the support element 20 with respect to the cover element 22. When connecting the cover element 22 to the support element 20, the cover element 22 is moved in a direction which is at least substantially parallel to the main extension plane of the inner wall section 12 until the alignment element 72 and the corresponding alignment element 74 are aligned with each other. The alignment element 72 is implemented as an alignment hole. The corresponding alignment element 74 is implemented as a further alignment hole.

For mounting the door mullion 18 to the inner wall section 12, the support unit 14 comprises at least one mounting element 32 which a corresponding mounting element 33 of the door mullion 18 can be attached to. The mounting element 32 is implemented as a screw bore. The corresponding mounting element 33 is embodied as a hanger screw and/or hanger bolt. The mounting element 32 is arranged at a lateral side of the support element 20 which in particular faces towards the door mullion 18. The cover element 22 comprises an assembly recess 76 which is configured for preventing the mounting element 32 of the support element 20 being covered. The assembly recess 76 is positioned such that the mounting element 32 of the support element 20 remains free of coverage by the cover element 22.

FIG. 4 shows a portion of the home appliance door 10 with the further support unit 15. The further support unit 15 has a further support element 21. The further support element 21 is implemented at least substantially identically to the support element 20 of the support unit 14.

The further support unit 15 comprises a further cover element 23. An implementation of the further cover element 23 differs from the implementation of the cover element 22. The further cover element 23 comprises an assembly recess 80. The further cover element 23 comprises an additional assembly recess 82. The additional assembly recess 82 is positioned such that a further receiving recess 84 of the further support element 21 remains free of coverage by the cover element 23.

Furthermore, the cover sheet 36 comprises a cut-out 40 in a vicinity of the support unit 15, in a fixated state of the support unit 15.

The following is a summary list of reference numerals and the corresponding structure used in the above description of the invention:

10 Home appliance door
11 Home appliance door
12 Inner wall section
14 Support unit
15 Further support unit
18 Door mullion
20 Support element
21 Further support element
22 Cover element
23 Further cover element
24 Connection element
28 Corresponding connection element
32 Mounting element
33 Mounting element
34 Inner liner
36 Cover sheet
38 Hollow portion
40 Cut-out
42 Home appliance
44 Housing
48 Door housing
50 Outer wall section
52 Fixation unit
54 Door frame
56 Fixation element
58 Further fixation element
60 Interaction element
62 First fixation sub-element
64 Second fixation sub-element
66 Assembly space
68 Receiving space
70 Connection recess
72 Alignment element
74 Alignment element
76 Assembly recess
78 Receiving recess

80 Assembly recess
82 Additional assembly recess
84 Further receiving recess

The invention claimed is:

1. A home appliance door, comprising:

an outer wall facing away from a storage space defined by the door and defining a front of the door;

an inner wall section having a planar side defining a flat surface parallel to the outer wall, the inner wall and the outer wall delimiting an interior space of the door over an area of the flat surface, the interior space being filled with insulation; and at least one support unit for support of a door mullion, the support unit being directly fastened to the flat surface of the inner wall section.

2. The home appliance door according to claim 1, the support unit comprising a support element for supporting the door mullion, and a cover element which at least partly covers the support element.

3. The home appliance door according to claim 2, the cover element comprising at least one connection element and the support element comprising at least one corresponding connection element cooperating with the connection element for connecting the cover element to the support element.

4. The home appliance door according to claim 2, the cover element being fixable to the support element by at least one movement of the cover element with respect to the support element in a direction which is at least substantially parallel to a main extension plane of the inner wall section.

5. The home appliance door according to claim 1, further comprising the door mullion, wherein the support unit comprises at least one mounting element for mounting the door mullion to the inner wall section.

6. The home appliance door according to claim 2, the support element being implemented in one piece.

7. The home appliance door according to claim 2, the support element being implemented as a bent piece of sheet metal.

8. The home appliance door according to claim 1, the inner wall section comprising an inner liner and a cover sheet which at least partly covers the inner liner.

9. The home appliance door according to claim 8, the cover sheet being arranged at least partly between the inner liner and the support unit, in a fixated state of the support unit.

10. The home appliance door according to claim 8, the inner liner comprising a hollow portion in a vicinity of the support unit, in a fixated state of the support unit.

11. The home appliance door according to claim 8, the cover sheet comprising a cut-out in a vicinity of the support unit, in a fixated state of the support unit.

12. The home appliance door according to claim 2, comprising a further support unit having a further support element which is implemented at least substantially identically to the support element of the support unit.

13. The home appliance door according to claim 1, configured as a home chiller appliance door.

14. A home appliance, in particular a home chiller appliance, comprising a home appliance door according to claim 1.

15. A method for assembly of a home appliance door comprising:

providing an outer wall facing away from a storage space defined by the door and defining a front of the door;

providing an inner wall section having a planar side defining a flat surface parallel to the outer wall, the inner wall and the outer wall delimiting an interior space of the door over an area of the flat surface, the interior space being filled with insulation; and directly fastening at least one support unit for support of a door mullion to the flat surface of the inner wall section.

* * * * *